US010368613B2

(12) United States Patent
Ha

(10) Patent No.: US 10,368,613 B2
(45) Date of Patent: Aug. 6, 2019

(54) WIRE TIGHTENING APPARATUS

(71) Applicant: Young Ho Ha, Gangseo-gu Busan (KR)

(72) Inventor: Young Ho Ha, Gangseo-gu Busan (KR)

( * ) Notice: Subject to any disclaimer, the term of this patent is extended or adjusted under 35 U.S.C. 154(b) by 0 days.

(21) Appl. No.: 15/668,697

(22) Filed: Aug. 4, 2017

(65) Prior Publication Data

US 2017/0325548 A1 Nov. 16, 2017

Related U.S. Application Data

(63) Continuation of application No. PCT/KR2016/011784, filed on Oct. 20, 2016.

(30) Foreign Application Priority Data

Feb. 11, 2016 (KR) ..... 10-2016-0015454
Jun. 20, 2016 (KR) ..... 10-2016-0076540

(51) Int. Cl.
*A43C 11/16* (2006.01)
*A43C 7/00* (2006.01)

(52) U.S. Cl.
CPC ..... *A43C 11/165* (2013.01); *A43C 7/00* (2013.01)

(58) Field of Classification Search
CPC ..... A43C 11/165; A43C 7/00
See application file for complete search history.

(56) References Cited

U.S. PATENT DOCUMENTS 7,076,843 B2 * 7/2006 Sakabayashi ..... A43C 7/00 24/68 SK
7,367,522 B2 * 5/2008 Chen ..... A43C 7/00 24/68 SK
8,245,371 B2 * 8/2012 Chen ..... A43C 7/00 24/68 B
8,353,087 B2 * 1/2013 Chen ..... A43C 11/165 24/68 SK (Continued)

FOREIGN PATENT DOCUMENTS

KR 10-1040372 B 6/2011
KR 10-2012-0027105 A 3/2012

(Continued)

*Primary Examiner* — Robert Sandy
*Assistant Examiner* — David M Upchurch
(74) *Attorney, Agent, or Firm* — Yokoi & Co., U.S.A.; Toshiyuki Yokoi

(57) ABSTRACT

To enhance ease of assembly and durability, the disclosure provides a wire tightening apparatus including: a bottom part provided with an accommodation groove at an upper surface portion thereof; a reel part rotatably inserted into the accommodation groove; a housing part including a fixing barrier part, a lower end portion of which is fixed to the accommodation groove, an extension part extending inward in a radial direction along an inner circumference of the fixing barrier part and provided with a hollow-type support tube part at a central portion thereof, and an elastic blade portion positioned at an upper portion of the extension part and provided with a ratchet coupling part at an end portion thereof; a vertically moving gear part provided with a ratchet (Continued)

gear protruding from an inner circumference thereof; and a cover part coupled to an upper portion of the vertically moving gear part.

9 Claims, 10 Drawing Sheets

(56) References Cited

U.S. PATENT DOCUMENTS

| | | | | |
|---|---|---|---|---|
| 9,101,181 | B2 * | 8/2015 | Soderberg | A43C 11/165 |
| 9,179,729 | B2 * | 11/2015 | Cotterman | A42B 3/08 |
| 9,486,039 | B2 * | 11/2016 | Ha | A43C 11/165 |
| 2006/0156517 | A1 * | 7/2006 | Hammerslag | A43B 5/16 24/68 SK |
| 2008/0196224 | A1 * | 8/2008 | Hu | A43C 11/16 24/68 SK |
| 2010/0101061 | A1 * | 4/2010 | Ha | A43B 3/0042 24/712.5 |
| 2010/0139057 | A1 * | 6/2010 | Soderberg | A43C 11/16 24/68 R |
| 2011/0266384 | A1 * | 11/2011 | Goodman | A43C 11/165 242/396.4 |
| 2013/0025100 | A1 * | 1/2013 | Ha | A43C 11/165 24/712.9 |
| 2014/0359981 | A1 | 12/2014 | Cotterman et al. | |

FOREIGN PATENT DOCUMENTS

| | | | |
|---|---|---|---|
| KR | 10-1249420 | B | 4/2013 |
| KR | 10-1438572 | B | 9/2014 |

* cited by examiner

WIRE TIGHTENING APPARATUS

CROSS-REFERENCES TO RELATED APPLICATIONS

This Application claims the benefit of priority and is a Continuation application of the prior International Patent Application No. PCT/KR2016/011784, with an international filing date of Oct. 20, 2016, which designated the United States, and is related to the Korean Patent Application No. 10-2016-0015454, filed Jan. 22, 2016 and the Korean Patent Application No. 10-2015-0076540, filed Jun. 20, 2016, the entire disclosures of all applications are expressly incorporated by reference in their entirety herein.

BACKGROUND OF THE INVENTION

1. Field of the Invention

The present invention relates to a wire tightening apparatus, and more particularly, to a wire tightening apparatus with enhanced durability and ease of assembly.

2. Description of Related Art

Generally, shoes such as running shoes and the like can be worn in such a manner that feet of a user are brought into close contact with an upper of the shoes by tying shoelaces laced in a zigzag manner. At this time, comfortable walking is possible when shoelaces are tightened, and sufficient rest is possible when shoelaces are loosened.

However, loosening and tightening of shoelaces are not easy, and, when shoelaces come untied during exercise, results such as poor performance, occurrence of accidents, and the like are encountered, and thus it is necessary to absolutely prevent shoelaces from coming untied. That is, most preferably, shoelaces should be easily tightened, a tightened state should be stably maintained, and, if necessary, shoelaces should be loosened easily. Thus, a variety of apparatuses for facilitating tightening and loosening of shoelaces, which are opposite operations, have been developed.

FIG. 1 is a perspective view of a shoe equipped with a conventional shoelace tightening apparatus. FIG. 2 is an exploded perspective view of the conventional shoelace tightening apparatus.

As illustrated in FIGS. 1 and 2, the conventional shoelace tightening apparatus 10 is provided at a tongue T of a shoe, and, when a cover part 51 is rotated, an intermediate member 53 and a winding member 55 are coupled and rotate together. At this time, a shoelace L is wound on the winding member 55, and an engagement and restriction portion 53*z* of the intermediate member is locked in a one-way ratchet gear 57*c* of a housing 57, and thus reverse movement may be prevented.

Subsequently, when the cover part 51 is pulled upward, a restriction step portion 62 of a rotary shaft 61 moves upward while stretching an elastic member 59 by elastically pressing the elastic member 59, and the intermediate member 53 ascends. Accordingly, the intermediate member 53 and the winding member 55 are uncoupled and the shoelace L may be loosened by pulling via free rotation of the winding member 55.

For this, the elastic member 59 formed of a U-shaped thin metal material is separately fabricated, and the elastic member 59 has problems in terms of being assembled in the shoelace tightening apparatus 10 through complicated assembly processes.

In addition, the conventional shoelace tightening apparatus 10 has problems in that, when the cover part 51 is pulled upward so that the shoelace is loosened, the elastic member 59 escapes from the original position, resulting in occurrence of breakdown. To address these problems, when a lower structure of a housing 57 to which the elastic member 59 is coupled is modified into a complicated structure, the productivity of products is deteriorated due to structural complexity and increase in the number of components.

Furthermore, the cover part 51 and the rotary shaft 61 are mutually fastened by a bolt member, and thus, when the bolt member is not completely fastened, malfunction occurs. At this time, when the cover part 51 is forcibly manipulated, the rotary shaft 61 made of an injection-molded resin material is easily broken by the bolt member formed of a metal material.

BRIEF SUMMARY OF THE INVENTION

Therefore, the present invention has been made in view of the above problems, and it is one object of the present invention to provide a wire tightening apparatus with enhanced durability and ease of assembly.

In accordance with one aspect of the present invention, provided is a wire tightening apparatus including: a bottom part provided with an accommodation groove at an upper surface portion thereof; a reel part rotatably inserted into the accommodation groove and allowing a wire to be selectively wound thereon during rotation; a housing part comprising a fixing barrier part, a lower end portion of which is fixed to the accommodation groove, an extension part extending inward in a radial direction along an inner circumference of the fixing barrier part to cover the reel part and provided with a hollow-type support tube part at a central portion thereof, and an elastic blade portion positioned at an upper portion of the extension part and provided with a ratchet coupling part at an end portion thereof; a vertically moving gear part provided with a ratchet gear protruding from an inner circumference thereof so that one-way rotation thereof is restricted by the ratchet coupling part and vertically moving by external force; and a cover part coupled to an upper portion of the vertically moving gear part to move upward or downward and rotate in an integrated manner and provided, at a lower surface portion thereof, with a lifting protrusion guided along the support tube part to be coupled to an upper surface portion of the reel part when moving downward.

In accordance with another aspect of the present invention, provided is a wire tightening apparatus including: a housing part provided with a one-way ratchet gear along a circumferential direction at an inner circumference thereof; a reel part rotatably inserted into the housing part and allowing a wire to be selectively wound thereon; a rotation restriction part engaged with the ratchet gear, by which one-way rotation thereof is restricted, provided with a vertical movement support hole with upper and lower openings along a central portion thereof, and moving upward or downward by external force such that, when moving downward, the rotation restriction part is coupled to an upper portion of the reel part to rotate in an integrated manner; and a vertical movement support shaft part comprising a shaft body part coupled to a lower portion of the housing part, elastic pieces extending upward from an upper end of the shaft body part to be divided by a plurality of slits and passing through the vertical movement support hole, and pressure gradient protrusions protruding from outer surfaces of the elastic pieces to exceed an inner diameter of the vertical movement support hole so that the vertical movement support hole is elastically supported by elastic tightening and restoration of the elastic pieces.

As is apparent from the fore-going description, a wire tightening apparatus of the present invention provides the following effects:

First, a slide protrusion protruding from an elastic piece is elastically caught by a pressure fixing step, and a lifting state of a vertically moving gear part for tightening and loosening a wire may be stably maintained, and thus product stability and user convenience can be enhanced.

Second, the elastic piece and the slide protrusion are provided in the vertically moving gear part in an integrated form, and thus the lifting state of the vertically moving gear part can be maintained without separate additional components such as an elastic member and, accordingly, the number of constituent components decreases, resulting in enhancement of productivity and ease of assembly of products.

Third, constituent components in an integrated form, such as a bottom part, a housing part, the vertically moving gear part, the cover part, and the like, are repeatedly assembled by a simple hook coupling process in which two neighboring components are pressed in a vertical direction, and thus productivity of products can be enhanced. In addition, a separate fixing member made of a metal material for assembly between the constituent components is not needed, and thus breakdown of components formed of a resin that may occur due to a metal fixing member during manipulation via external force is fundamentally prevented, and thus durability of products can be enhanced.

Fourth, an outer surface of the vertically moving gear part is supported by the cover part, and thus hook coupling between the housing part and the vertically moving gear part via first hook projections is stably maintained, and the cover part is hook-coupled using a space between the first hook projections, and thus more compact products can be designed.

Fifth, the elastic piece and a pressure gradient protrusion, used to maintain a lifting state of a rotation restriction part, are injection-molded in a vertical movement support shaft part in an integrated form, and thus the number of constituent components decreases, resulting in enhancement of the productivity and ease of assembly of products.

Sixth, the vertical movement support shaft part can be hook-coupled to the housing part via a divided cylindrical hook protrusion provided at a lower end portion thereof without a separate fixing member made of a metal material, and thus destruction of the resin injection material due to pressurization of the metal fixing member during manipulation of vertical movement can be prevented.

Seventh, the cover part and the housing part are readily coupled via one touch-type hook coupling through a hooking protrusion and hook blade portions, and the cover part is lifted within an accurate range, and thus separation and breakdown of components due to excessive vertical movement can be prevented.

DETAILED DESCRIPTION OF THE INVENTION

The best mode of the present invention will be described below in more detail with reference to the accompanying drawings.

Hereinafter, wire tightening apparatuses according to exemplary embodiments of the present invention will be described in detail with reference to the accompanying drawings.

Figure 3A:
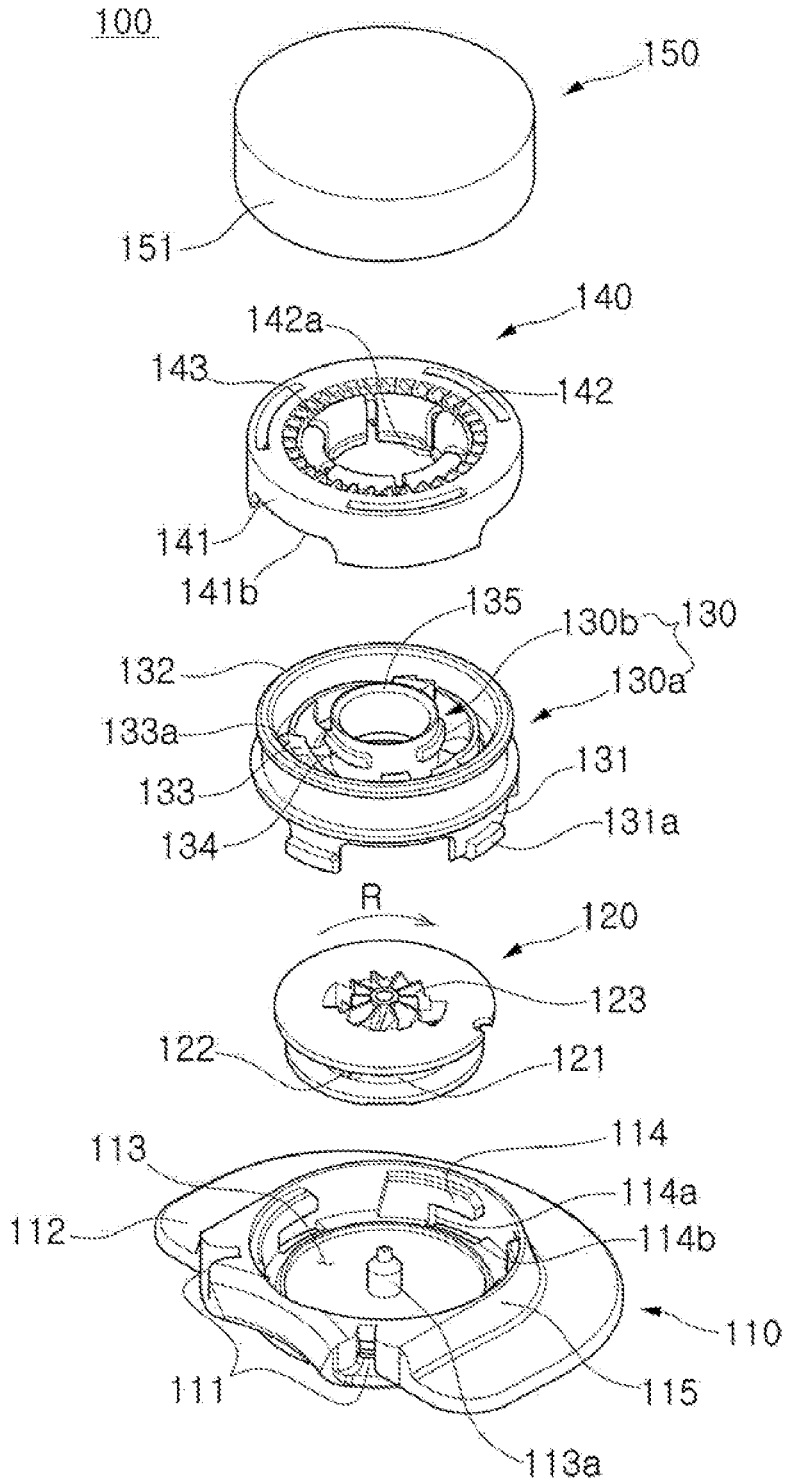
FIGS. 3A and 3B are exploded perspective views of a wire tightening apparatus according to an embodiment of the present invention.
Figure 3B:
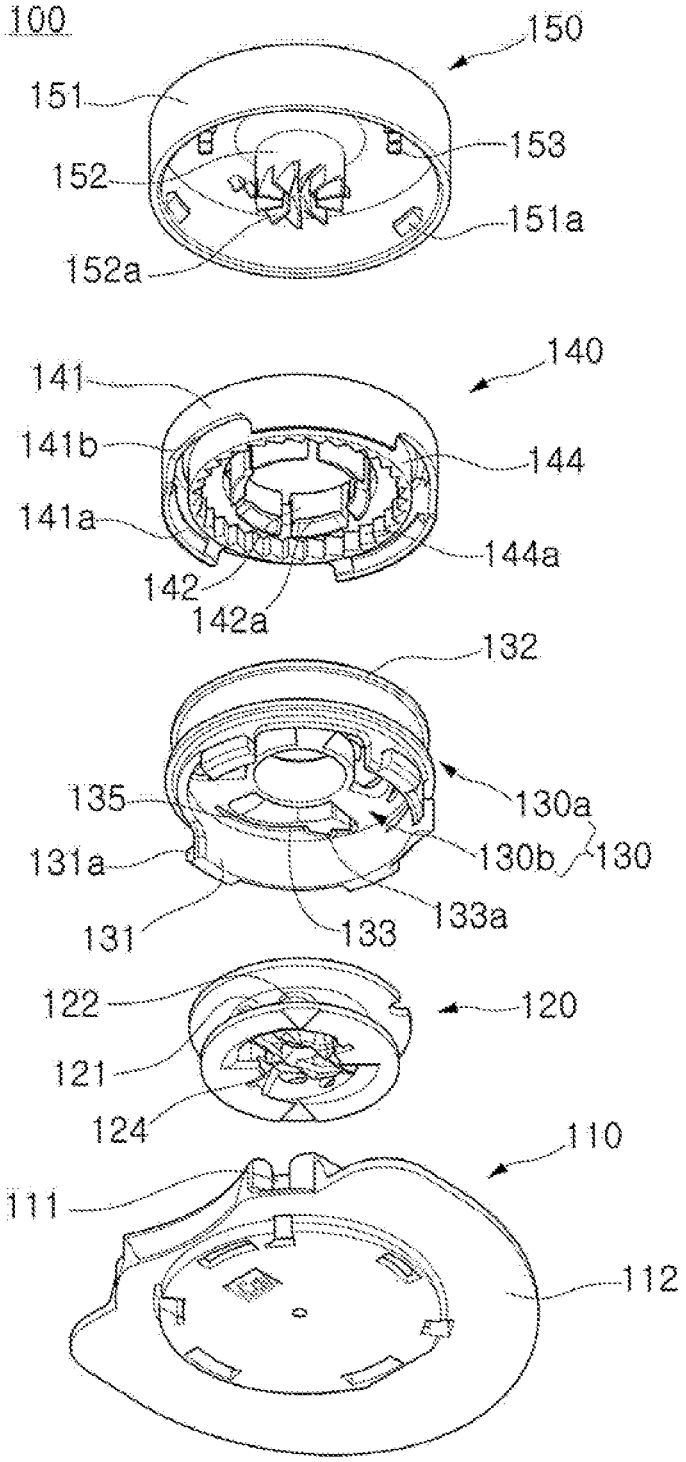
Figure 4A:
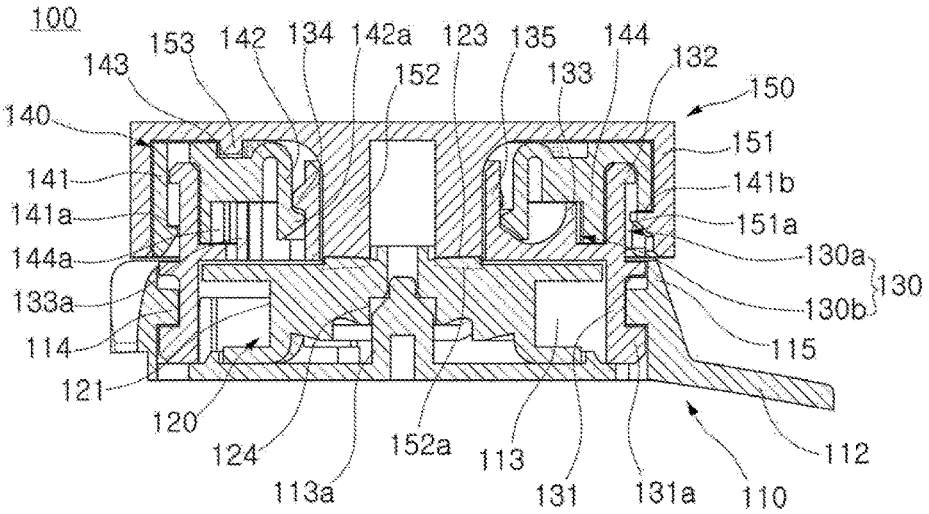
FIGS. 4A and 4B are cross-sectional views of the wire tightening apparatus according to an embodiment of the present invention.
Figure 4B:
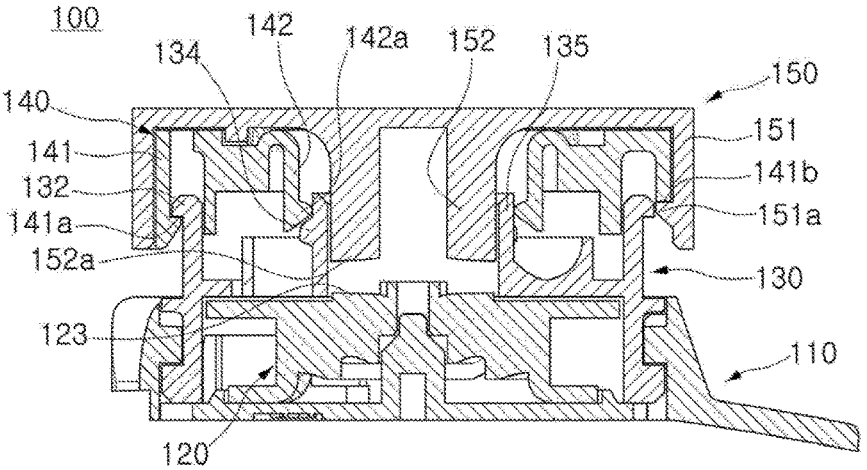

FIGS. 3A and 3B are exploded perspective views of a wire tightening apparatus according to an embodiment of the present invention. FIGS. 4A and 4B are cross-sectional views of the wire tightening apparatus according to an embodiment of the present invention.

As illustrated in FIGS. 3A, 3B, 4A, and 4B, the wire tightening apparatus 100 includes a bottom part 110, a reel part 120, a housing part 130, a vertically moving gear part 140, and a cover part 150. In this regard, the bottom part 110 may be formed of a resin material that has a certain degree or more of strength and is elastic, such as reinforced plastic, or the like.

In detail, the bottom part 110 includes a tongue support part 112 having a rounded lower surface portion so as to closely support a tongue or the like of a shoe, and an accommodation barrier part 115 protruding from a central portion of the tongue support part 112. In addition, an accommodation groove 113 is formed in the accommodation barrier part 115, and the accommodation barrier part 115 may be provided, at one side thereof, a pair of wire through-holes 111 to penetrate the accommodation barrier part 115 so as to be connected with the accommodation groove 113.

Referring to FIGS. 3A, 3B, 4A, and 4B, the reel part 120 may be made of a resin material such as reinforced plastic, or the like, and may have an outer diameter that is less than an inner diameter of the accommodation groove 113 to be inserted into the accommodation groove 113.

At this time, a rotation support protrusion 113*a* protruding from a central portion of a bottom surface of the accommodation groove 113 is inserted into a protrusion accommodation groove 124 formed at a central portion of a lower surface of the reel part 120, and, accordingly, the reel part 120 may accurately rotate about the rotation support protrusion 113*a* as a rotary shaft. In addition, the reel part 120 is provided, at an edge surface, with an annular wire winding groove 121 inward recessed in a radial direction, and the wire winding groove 121 is provided with a wire fixing hole 122.

Specifically, opposite end portions of a wire are connected to an object to be tightened, e.g., a shoe or the like, via the wire through-hole 111 of the accommodation barrier part 115 in a state in which the wire is fixed in the wire fixing hole 122. At this time, when the reel part 120 rotates in another direction R (clockwise of FIG. 3A), the wire may be wound along the wire winding groove 121, and, when the reel part 120 rotates in one direction, the wound wire may be unwound from the wire winding groove 121.

In addition, directions in which the wire is wound and unwound may be easily modified in terms of design by changing the shape of each constituent component described below. At this time, when the reel part 120 is inserted into the accommodation groove 113 of the bottom part 110, and the wire is fixed in the reel part 120, the housing part 130 is coupled to an upper portion of the accommodation groove 113.

Meanwhile, the housing part 130 may include a fixing barrier part 130*a* and an extension part 130*b* and be made of a resin material such as reinforced plastic or the like. In this regard, the fixing barrier part 130*a* has an outer diameter that is less than an inner diameter of the accommodation barrier part 115 of the bottom part 110 and has a cylindrical shape having an inner diameter corresponding to an outer diameter of the reel part 120.

In addition, the fixing barrier part 130*a* is provided, at a lower end portion thereof, with a plurality of hook blade portions 131 extending downward to be inserted into a space between the reel part 120 and the accommodation barrier part 115, each hook blade portion 131 having a fixing protrusion 131*a* protruding from an outer surface portion thereof.

At this time, fixing steps 114 inward protrude from an inner surface of the accommodation barrier part 115 in a radial direction, and the fixing protrusions 131*a* and the fixing steps 114 may protrude to correspond to a distance between outer surfaces of the hook blade portions 131 and an inner surface of the accommodation groove 113.

Accordingly, the hook blade portions 131 are inserted into the accommodation groove 113, and thus the fixing protrusions 131*a* are caught by lower ends of the fixing steps 114, and the fixing barrier part 130*a* may be hook-coupled to the accommodation groove 113.

In addition, the fixing step 114 is provided, at opposite sides of a lower portion thereof, with support steps 114*a* and 114*b* to correspond to a transverse width of the fixing protrusion 131*a*, and thus the fixing protrusions 131*a* caught by the lower end portions of the fixing steps 114 are fixed. Accordingly, the housing part 130 may be fixedly coupled to the bottom part 110.

In addition, the fixing barrier part 130*a* is provided, at an inner circumference thereof, with an extension part 130*b* inward extending in a radial direction to cover the reel part 120. At this time, the extension part 130*b* may protrude from a portion of the fixing barrier part 130*a* fixed to the bottom part 110, corresponding to an upper end portion of the reel part 120. Accordingly, an upper surface portion of the reel part 120 may be supported by a lower end portion of the extension part 130*b*, and upward or downward movement of the reel part 120 may be minimized.

In addition, the extension part 130*b* is provided with a hollow support tube part 135 at an end portion thereof, and the hollow support tube part 135 is configured such that a lower end portion thereof is connected to the extension part 130*b* and an upper end portion thereof is positioned at a height corresponding to an upper end portion of the fixing barrier part 130*a*.

In addition, the extension part 130*b* is provided with an elastic blade portion 133 at an upper portion thereof, and the elastic blade portion 133 may be configured in plural along the respective extension parts 130*b* that are radially arranged. At this time, each elastic blade portion 133 takes the form of a circular arc extending from one end portion thereof connected to an upper surface of each extension part 130*b* in another direction R, and is provided with a ratchet coupling part 133*a* at an outer surface of another end portion thereof facing an inner circumferential surface of the fixing barrier part 130*a*.

In this regard, the ratchet coupling part 133*a* may be provided with a plurality of gear teeth, an end portion in another direction R of each of which is formed as a vertical plane and a counterclockwise end portion thereof is inclined.

Meanwhile, referring to FIGS. 3A and 3B, the vertically moving gear part 140 includes sidewall portions 141 and 144 and elastic pieces 142 and may be made of a resin material such as reinforced plastic or the like. At this time, the vertically moving gear part 140 is coupled to an upper portion of the housing part 130.

Specifically, the sidewall part includes a first sidewall portion 141 protruding downward along an exterior portion of a lower surface of a disk-type body part with a central opening, and a second sidewall portion 144 protruding to be spaced apart from the first sidewall portion 141 by a predetermined distance. In addition, the elastic piece 142 may be configured in plural at an inner circumference of the opening of the body part and extend downward in a round shape.

At this time, the upper end portion of the fixing barrier part 130*a* may be inserted into a space between the first and second sidewall portions 141 and 144, and the second sidewall portion 144 may be inserted between the inner circumference of the fixing barrier part 130*a* and the elastic blade portions 133.

In this regard, the second sidewall portion 144 is provided, at an inner circumference thereof, with a ratchet-type gear 144*a*, one-way rotation of which is restricted by the ratchet coupling part 133*a*, in a circumferential direction. At this time, the ratchet-type gear 144*a* includes a plurality of gear teeth engaged with the ratchet coupling part 133*a*.

That is, vertical cross-sections of the ratchet coupling part 133*a* and the ratchet-type gear 144*a* are engaged with each other in a state in which the ratchet coupling part 133*a* is elastically supported by the elastic blade portions 133 outward in a radial direction, and thus one-way rotation of the vertically moving gear part 140 may be restricted.

At this time, as the elastic blade portions 133 are elastically deformed inward in a radial direction and the ratchet-type gear 144*a* slides along a slope of the ratchet coupling part 133*a*, the vertically moving gear part 140 may rotate in another direction R. In addition, the cover part 150 may be coupled to an upper portion of the vertically moving gear part 140, and the vertically moving gear part 140 may be lifted and rotated by external force transmitted by the cover part 150.

In addition, first hook protrusions 141*a* protrude from an inner surface of the first sidewall portion 141 of the vertically moving gear part 140 to be hook-coupled to a hooking protrusion 132 protruding from an outer surface of the fixing barrier part 130*a*. Specifically, the hooking step 132 protrudes from an upper end portion of an outer circumference of the fixing barrier part 130*a* inserted into a space between the first and second sidewall portions 141 and 144. At this time, the hooking step 132 and the first hook protrusions 141*a* may protrude to correspond to a space between an inner surface of the first sidewall portion 141 and an outer surface of the fixing barrier part 130*a*.

In addition, the hooking step 132 is configured such that an upper end portion thereof is slanted downward towards the outer side in a radial direction and a lower end portion thereof is flat, and the first hook protrusion 141*a* is configured such that a lower end portion thereof is slanted upward towards the inner side in a radial direction and an upper end portion thereof is flat.

In this regard, when the fixing barrier part 130*a* is inserted into the space between the first and second sidewall portions 141 and 144, the first hook protrusions 141*a* may be caught by the hooking step 132, and thus the vertically moving gear part 140 and the housing part 130 may be hook-coupled to each other.

At this time, the first hook protrusion 141*a* may be configured in plural at the inner circumference of the first sidewall portion 141 in a circumferential direction within the same height range, and the first sidewall portion 141 and the fixing barrier part 130*a* may rotate in another direction in a hook-coupled state.

Meanwhile, the cover part 150 may be made of a resin material such as reinforced plastic or the like, and is coupled to the upper portion of the vertically moving gear part 140. At this time, the cover part 150 is provided therein with a space part corresponding to the volume of the vertically moving gear part 140, and thus may be coupled to cover the first sidewall portion 141 and the upper surface portion of the vertically moving gear part 140.

In addition, the cover part 150 is provided with a lifting protrusion 152 protruding from a central portion of a lower surface thereof, and the lifting protrusion 152 may be inserted into the support tube part 135 of the housing part 130 by passing through an inner opening in a radial direction of the elastic pieces 142.

At this time, second hook protrusions 151*a* protrude from a sidewall portion 151 of the cover part 150 along a lower end of an inner circumference thereof, and the first sidewall portion 141 may have upwardly recessed cover hooking grooves 141*b*, which are portions corresponding to spaces between the first hook protrusions 141*a*.

In this regard, the second hook protrusions 151*a* may be configured such that lower end portions thereof are slanted upward towards an inner side in a radial direction and upper end portions thereof are flat. In addition, the second hook protrusions 151*a* may be inserted into and caught by the cover hooking grooves 141*b* so that the cover part 150 and the vertically moving gear part 140 are hook-coupled to each other.

In addition, a distance between upper ends of the cover hooking grooves 141*b* and an upper end of the first sidewall portion 141 may correspond to a distance between upper ends of the second hook protrusions 151*a* and an upper end of the sidewall portion 151 of the cover part 150. Accordingly, when the vertically moving gear part 140 and the cover part 150 are hook-coupled, a lower surface portion of the cover part 150 and an upper surface portion of the vertically moving gear part 140 may closely contact each other so that the cover part 150 and the vertically moving gear part 140 may be integrally lifted.

At this time, the cover part 150 may be provided, at a lower surface portion thereof, with a gear assembly part 153 including a plurality of gear teeth at the exterior part of the lifting protrusion 152, and the vertically moving gear part 140 may be provided with an assembly and engagement portion 143 engaged with the gear assembly part 153 at an upper surface portion thereof.

Accordingly, the vertically moving gear part 140 and the cover part 150 may integrally rotate when closely contacting each other through gear coupling of the gear assembly part 153 and the assembly and engagement portion 143.

As such, constituent components such as the bottom part 110, the housing part 130, the vertically moving gear part 140, the cover part 150, and the like are assembled by repeating a simple hook-coupling process in which two neighboring components are pressed upward or downward, and thus productivity of products may be enhanced.

Furthermore, a separate fixing member is not required, and thus breakdown of components formed of a resin material, due to metal components used as a fixing member during manipulation through external force, may be fundamentally prevented, whereby durability of products may be enhanced. In addition, the lifting protrusion 152 may have an outer diameter corresponding to an inner diameter of a hollow hole of the support tube part 135, and may be guided along the inner circumference of the support tube part 135 to be lifted. At this time, the lifting protrusion 152 is provided with a gear engagement portion 152*a* at a lower surface portion thereof, and the reel part 120 is provided, at an upper surface portion thereof, with a gear coupling part 123 in a shape engaged with the gear engagement portion 152*a*.

In addition, the lifting protrusion 152 may have a length that allows the vertically moving gear part 140 and the cover part 150 to closely contact the upper surface portion of the reel part 120 in a state in which the vertically moving gear part 140 and the cover part 150 descend in a state of closely contacting the housing part 130. Accordingly, when the vertically moving gear part 140 and the cover part 150 descend, the gear engagement portion 152*a* closely contacts the gear coupling part 123 and thus the reel part 120 and the cover part 150 may rotate in an integral form.

That is, referring to FIG. 4A, when the cover part 150 in a descending state rotates in another direction R, the cover part 150, the vertically moving gear part 140, and the reel part 120 integrally rotate in the other direction R and, as a result, a wire may be wound on the reel part 120. At this time, one-way rotation of the cover part 150 is restricted by the vertically moving gear part 140, and thus one-way rotation of the reel part 120 is restricted and, even when external force is not applied, the wire is not unwound.

Meanwhile, referring to FIGS. 4A and 4B, in hook-coupling, the upper ends of the first hook protrusions 141*a* and the lower end of the hooking step 132 may be spaced apart from each other by a distance corresponding to a lifting interval of the vertically moving gear part 140.

In this regard, it may be understood that the lifting interval means a distance between a position of the vertically moving gear part 140 in which the gear engagement portion 152*a* closely contacts the gear coupling part 123 and a position of the vertically moving gear part 140 in which the gear engagement portion 152*a* is separated from the gear coupling part 123.

At this time, the expression "spaced apart from" as used herein refers to a state in which the first hook protrusions 141*a* do not upwardly escape from the hooking step 132 and can move upward or downward in a state of being positioned at a lower portion of the hooking step 132.

For this, a height at which the first sidewall portion 141 of the vertically moving gear part 140 and the fixing barrier part 130*a* of the housing part 130 overlap each other, except for portions in which the first hook protrusions 141*a* and the hooking step 132 are formed, may be greater than the lifting interval.

Accordingly, when the vertically moving gear part 140 closely contacts the bottom part 110, a separation distance corresponding to the lifting interval may be formed between the upper end portions of the first hook protrusions 141*a* and the lower end portion of the hooking step 132.

Meanwhile, referring to FIG. 4B, the vertically moving gear part 140 and the cover part 150 may be lifted to correspond to separation between the first hook protrusions 141*a* and the hooking step 132.

That is, in a state in which the upper end portions of the first hook protrusions 141*a* are spaced apart from the lower end portion of the hooking step 132, the vertically moving gear part 140 may be lifted up to a position at which the upper end portions of the first hook protrusions 141*a* closely contact the lower end portion of the hooking step 132.

At this time, the gear coupling part 123 of the reel part 120 is separated from the gear engagement portion 152*a* of the lifting protrusion 152, and the reel part 120 may freely rotate independently from the cover part 150. That is, the reel part 120 may be converted into a free rotation state in a state in which one-way rotation thereof is restricted by the cover part 150, and the wire wound on the reel part 120 may be unwound.

In this regard, the first sidewall portion 141 is hook-coupled to the fixing barrier part 130*a*, and the sidewall portion 151 of the cover part 150 may cover and support the first sidewall portion 141 and be hook-coupled to the vertically moving gear part 140.

Accordingly, the sidewall portion 151 of the cover part 150 may support the first sidewall portion 141, from which the first hook protrusions 141*a* protrude, inward in a radial direction, and, when the vertically moving gear part 140 is lifted, the first hook protrusions 141*a* may be stably hooked by the hooking step 132.

In addition, the sidewall portion 151 of the cover part 150 may be hook-coupled to the cover hooking grooves 141*b* provided at side portions of the first hook protrusions 141*a*. Accordingly, the sidewall portion 151 of the cover part 150 may be designed to have a short height.

Meanwhile, the elastic pieces 142 may be provided at a central portion of the vertically moving gear part 140 to face an outer circumference of the support tube part 135, be configured in plural, and an inner surface portion of each elastic piece may be configured so as to surround the outer circumference of the support tube part 135.

At this time, the elastic pieces 142 may be connected to a central opening of the vertically moving gear part 140 via a rounded connection part so as to have elasticity, and the inner surface portions thereof may be configured so as to face the outer circumference of the support tube part 135, and, accordingly, the elastic pieces 142 may be elastically deformed outward and inward in a radial direction.

In this regard, slide protrusions 142*a* protrude inward in a radial direction at a lower end of the inner surface portion of each elastic piece 142. At this time, upper portions of the slide protrusions 142*a* are slanted downward towards the inner side in a radial direction, and lower portions thereof are slanted upward towards the inner side in a radial direction. That is, a vertical thickness of the slide protrusion 142*a* decreases towards the inner side in a radial direction, and end portions thereof inward in a radial direction to which the upper and lower portions of the slide protrusions 142*a* are connected are rounded.

In addition, the support tube part 135 is provided, at an outer circumference thereof, with a pressure fixing step 134 configured such that, when the vertically moving gear part 140 is lifted, the slide protrusions 142*a* are elastically caught thereby.

That is, the slide protrusions 142*a* move in a manner sliding from upward to downward or from downward to upward of the pressure fixing step 134 as the elastic pieces 142 are elastically deformed outward in a radial direction. In addition, as the elastic pieces 142 are elastically restored inward in a radial direction, the slide protrusions 142*a* may be seated in an upper portion of the pressure fixing step 134 or caught by a lower portion of the pressure fixing step 134.

In this regard, the pressure fixing step 134 may be configured such that the upper portion thereof is slanted downward towards the outer side in a radial direction, the lower portion thereof is slanted upward towards the outer side in a radial direction, and a vertical width thereof decreases towards the outer side in a radial direction. At this time, the pressure fixing step 134 and the slide protrusions 142*a* may protrude to correspond to a distance between the outer circumference of the support tube part 135 and the inner surface portions of the elastic pieces 142.

In this regard, a height at which the elastic pieces 142 and the support tube part 135 overlap each other may correspond to the lifting interval of the vertically moving gear part 140.

Specifically, the slide protrusions 142*a* may be caught by the lower portion of the pressure fixing step 134 in a state in which the vertically moving gear part 140 descends. At this time, the slide protrusions 142*a* are elastically supported by elastic force of the elastic pieces 142 inward in a radial direction, and the state in which the slide protrusions 142*a* are caught by the lower portion of the pressure fixing step 134 may be maintained.

Accordingly, the vertically moving gear part 140 moves downward and thus an integrally rotating state of the reel part 120, the cover part 150, and the vertically moving gear part 140 may be stably maintained. That is, malfunctions of the vertically moving gear part 140, such as lifting thereof by vibration or impact due to movement or the like, are prevented without direct manipulation by a user, and thus accidents in terms of safety, due to sudden loosening of wires during movement, and the like may be prevented, resulting in enhancement of the safety of products.

At this time, when the vertically moving gear part 140 and the cover part 150 move upward by external force, upper inclined surfaces of the slide protrusions 142*a* slide along a lower inclined surface of the pressure fixing step 134, and the slide protrusions 142*a* pass through the pressure fixing step 134. In addition, the slide protrusions 142*a* may be supported by elastic restoration force of the elastic pieces 142 inward in a radial direction and be seated in the upper portion of the pressure fixing step 134.

Accordingly, the lifting state of the vertically moving gear part 140 which allows the wire to be loosened by pulling without separate manipulation may be maintained and thus user convenience of products may be enhanced.

In addition, when the vertically moving gear part 140 and the cover part 150 are pressed downward, the lifting protrusion 152 and the reel part 120 may be easily converted into a coupled state.

Figure 1:
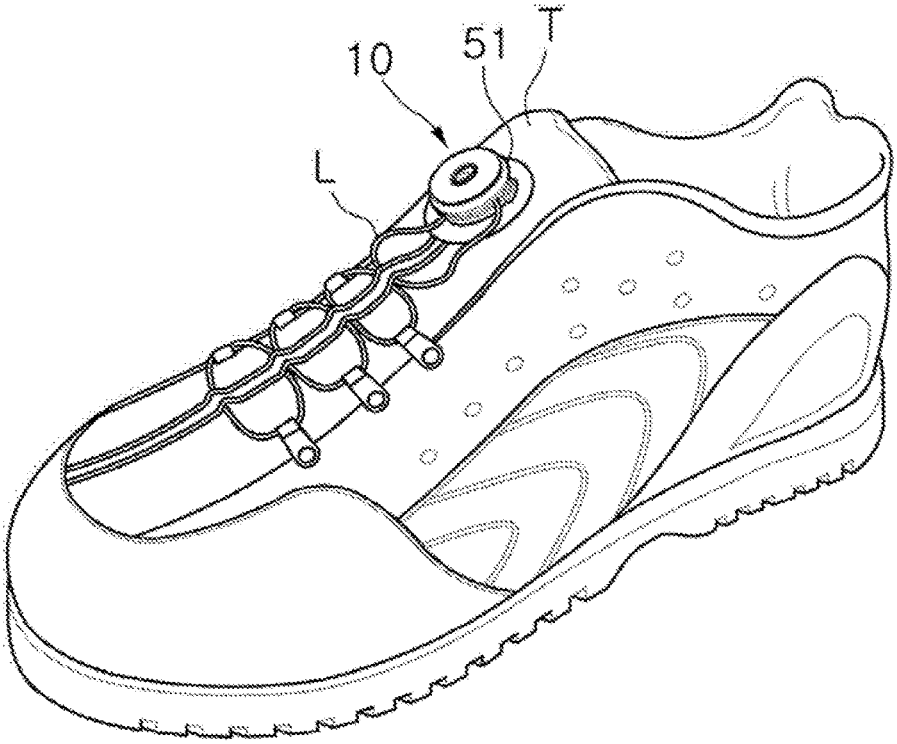
PRIOR ART FIG. 1
FIG. 1 is a perspective view of a shoe equipped with a conventional shoelace tightening apparatus.
Figure 2:
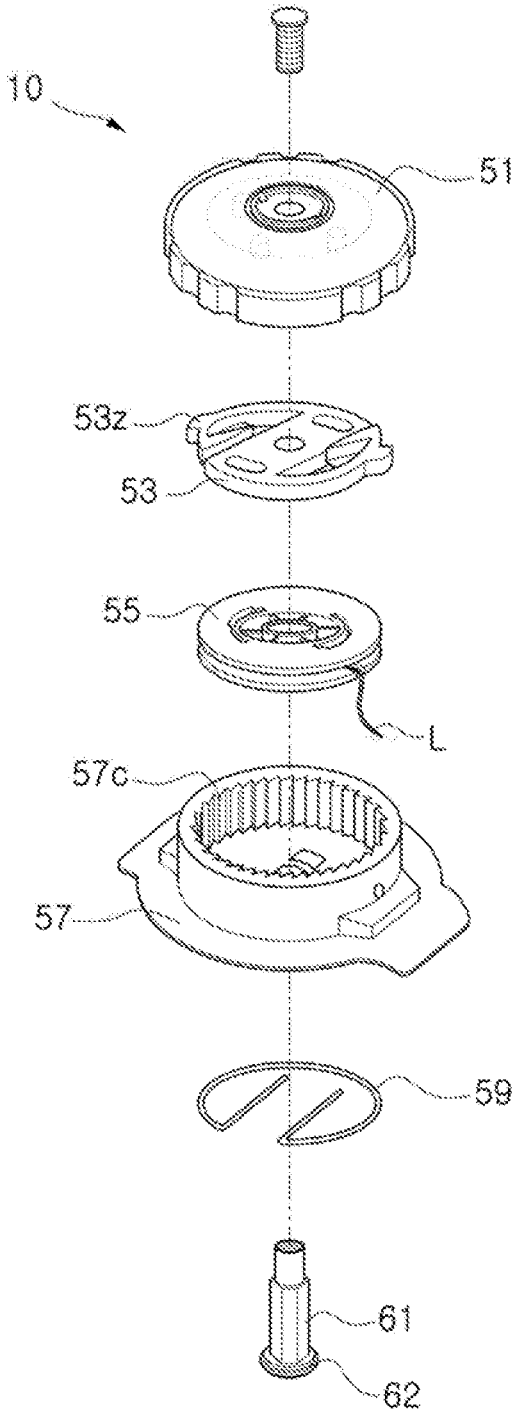
PRIOR ART FIG. 2
FIG. 2 is an exploded perspective view of the conventional shoelace tightening apparatus.

As such, the elastic pieces 142 and the slide protrusions 142*a* are configured in the vertically moving gear part 140 in an integrated form, and thus the number of constituent components (see reference numeral 59 of FIG. 2) for maintaining the lifting state of the vertically moving gear part 140 decreases and, accordingly, productivity and assemblability of products may be enhanced.

Figure 5:
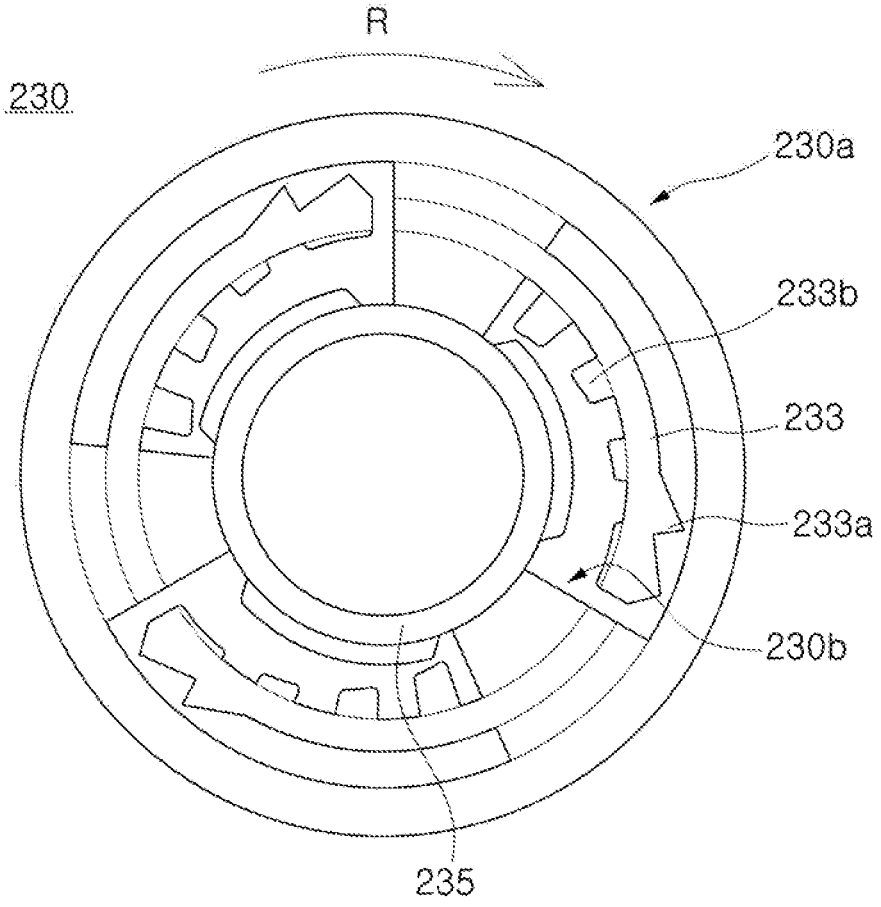
FIG. 5 is a plan view illustrating a modified example of a housing part of the wire tightening apparatus according to an embodiment of the present invention.

FIG. 5 is a plan view illustrating a modified example of the housing part of the wire tightening apparatus according to an embodiment of the present invention. In the present modified example, basic configurations of a housing part are the same as those of the above-described embodiment, except that elastic blade portions 233 are provided with distance maintenance portions 233*b*, and thus a detailed description of the same elements will be omitted.

As illustrated in FIG. 5, the elastic blade portion 233 may be provided, at an inner surface thereof, with a plurality of distance maintenance portions 233*b* protruding inward in a radial direction towards an outer circumference of a support tube part 235. At this time, the distance maintenance part 233*b* protrudes from an inner surface of a portion of each of a plurality of elastic blade portions 233, facing an upper portion of a space between extension portions 230*b*, and the distance maintenance parts 233*b* may be spaced apart from each other in a circumferential direction.

In addition, each distance maintenance part 233*b* protrudes such that a separation distance from an end portion of each distance maintenance part 233*b* to an outer circumference of a support tube part 235 decreases towards the extension portions 230*b*, and increases towards ratchet coupling parts 233*a*. Accordingly, the distance maintenance parts 233*b* may contact the outer circumference of the support tube part 235, thereby preventing excessive deformation of the elastic blade portions 233, and a decrease in elastic force due to the excessive deformation of the elastic blade portions 233 may be prevented.

Figure 6:
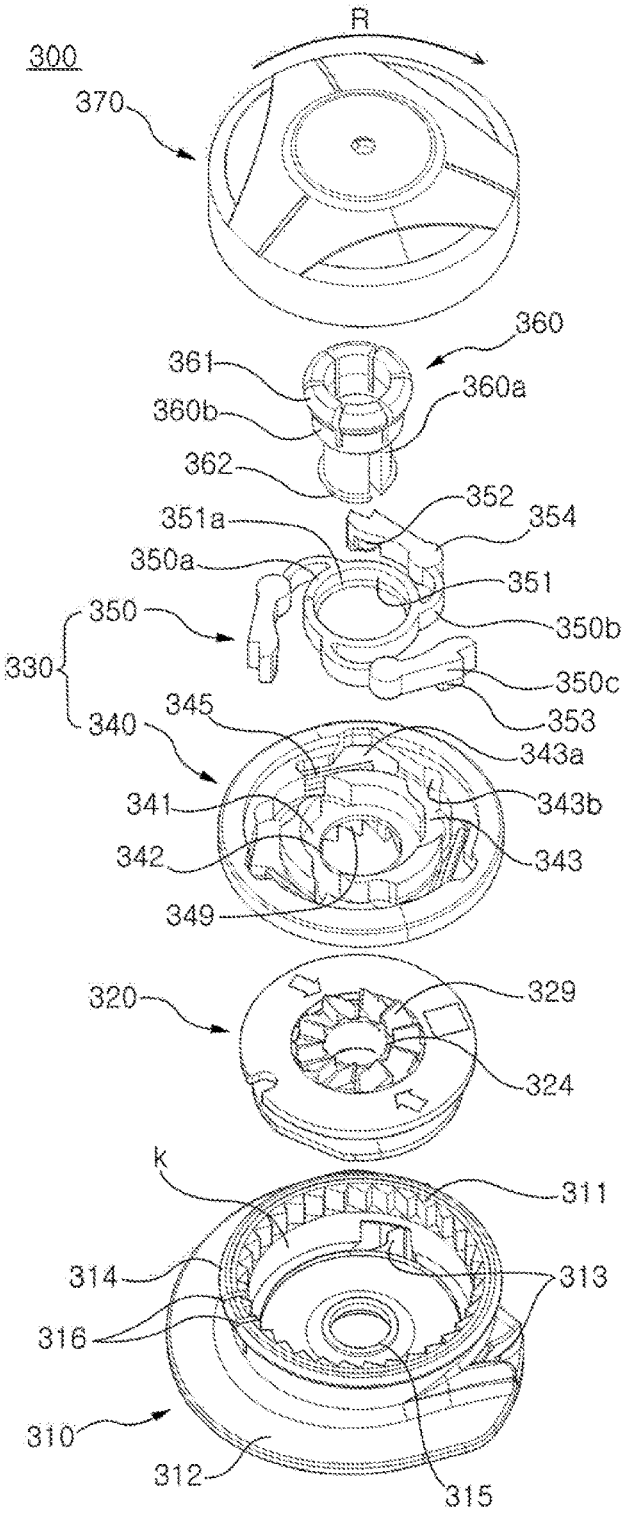
FIG. 6 is an exploded perspective view of a wire tightening apparatus according to another embodiment of the present invention.
Figure 7:
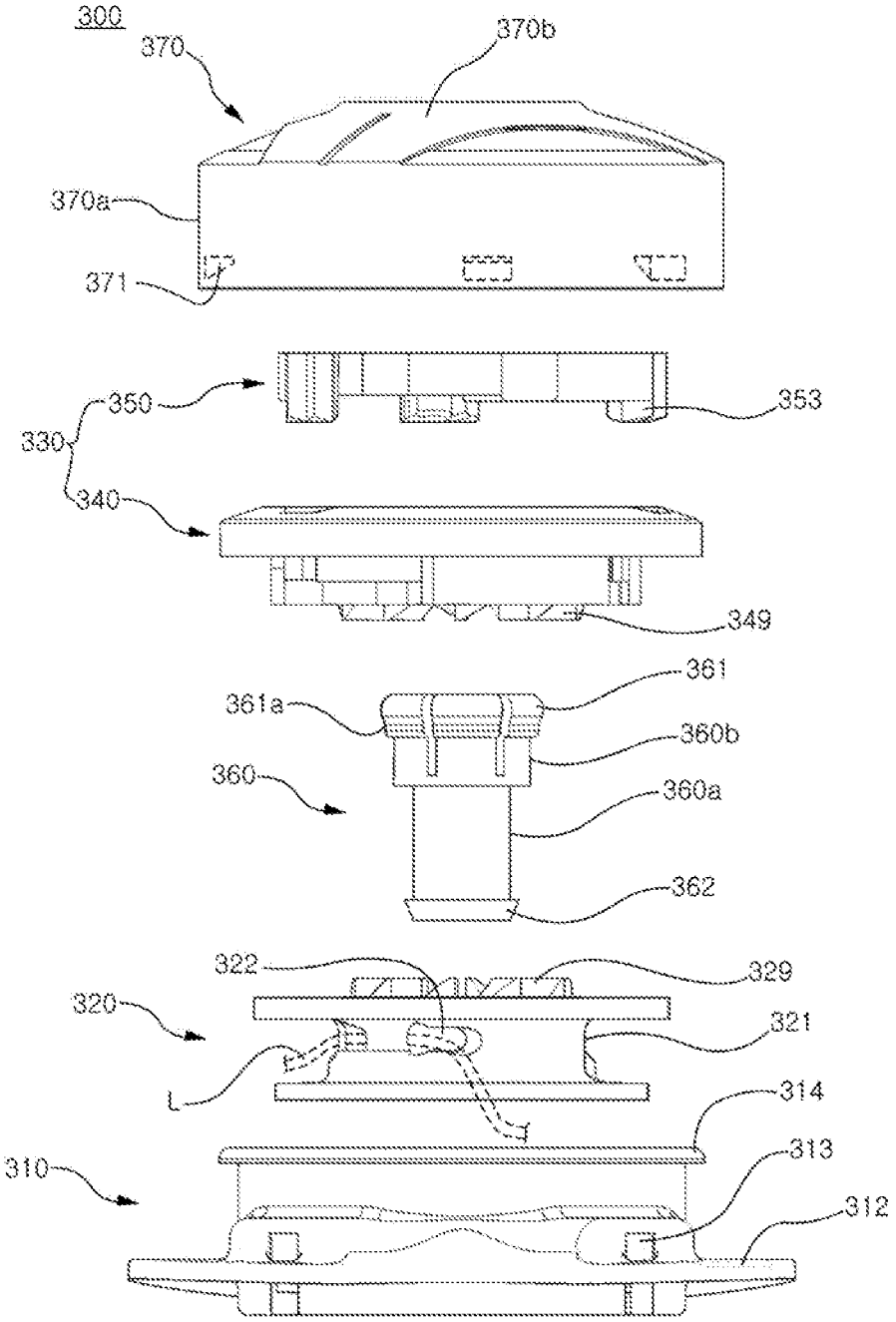
FIG. 7 is an exploded side view of the wire tightening apparatus according to another embodiment of the present invention.
Figure 8:
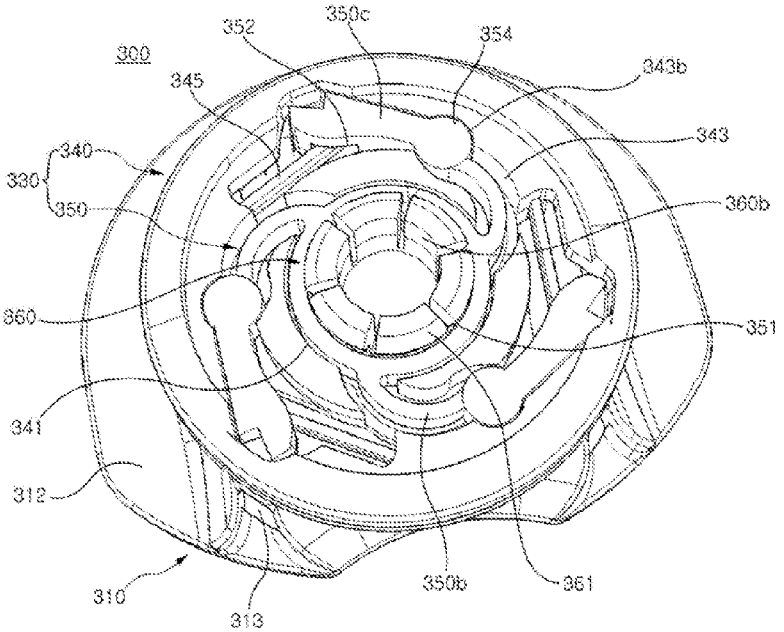
FIG. 8 is a partial perspective view illustrating a state in which a cover part of the wire tightening apparatus according to another embodiment of the present invention is removed.
Figure 9A:
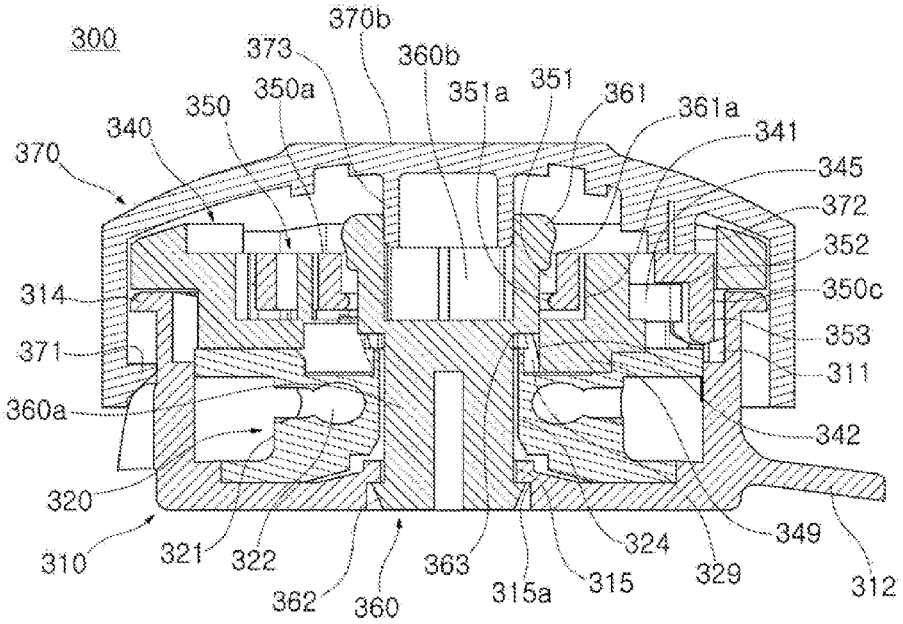
FIGS. 9A and 9B are cross-sectional views of the wire tightening apparatus according to another embodiment of the present invention.
Figure 9B:
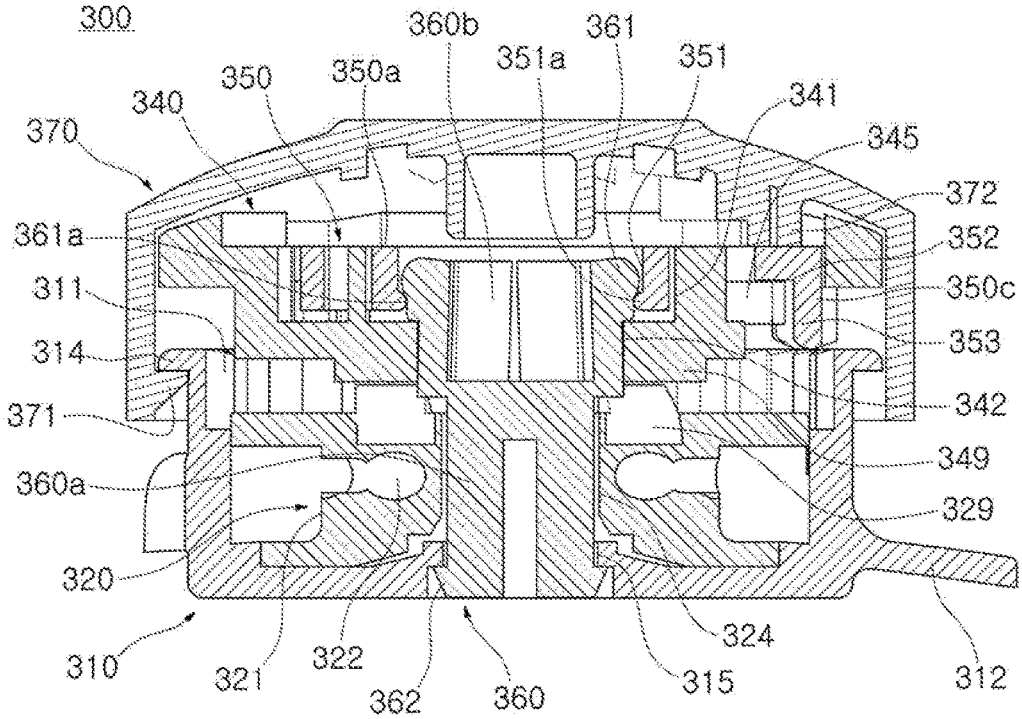

FIG. 6 is an exploded perspective view of a wire tightening apparatus according to another embodiment of the present invention. FIG. 7 is an exploded side view of the wire tightening apparatus according to another embodiment of the present invention. FIG. 8 is a partial perspective view illustrating a state in which a cover part of the wire tightening apparatus according to another embodiment of the present invention is removed. FIGS. 9A and 9B are cross-sectional views of the wire tightening apparatus according to another embodiment of the present invention.

In the other embodiment, basic configurations of the wire tightening apparatus are the same as those in the above-described embodiment, except for an integrally configured structure of a housing part and a bottom part, and conversion of tightening and loosening states of a reel part by a vertical movement support shaft part and a rotation restriction part, and thus a detailed description of the same elements will be omitted.

As illustrated in FIGS. 6 to 9B, the wire tightening apparatus 300 includes a housing part 310, a reel part 320, a rotation restriction part 330, and a vertical movement support shaft part 360.

In this regard, a tongue support portion 312 is configured in the housing part 310 in an integrated form, the reel part 320 is accommodated in a sidewall portion of the housing part 310, and a wire through-hole 313 through which a wire L passes is formed in one side of the sidewall portion of the housing part 310.

In addition, the reel part 320 includes a wire winding groove 321 and a wire fixing hole 322 that respectively winds and fixes the wire L.

In addition, the housing part 310 is provided with a ratchet gear 311 at an inner circumference of an upper portion of the sidewall portion thereof, and the rotation restriction part 330 is positioned above the reel part 320 to restrict one-way rotation of the ratchet gear 311.

At this time, the rotation restriction part 330 is moved upward by external force, and coupled to the reel part 320 when moving downward to rotate in an integrated form and may transmit rotational force in another direction R (clockwise of FIG. 6) to the reel part 320. In addition, as one-way rotation of the rotation restriction part 330 moving downward is restricted by the ratchet gear 311, one-way rotation of the reel part 320 may be restricted so that the wound wire L is not unwound.

In addition, when the rotation restriction part 330 moves upward by external force, the reel part 320 and the rotation restriction part 330 are separated from each other and thus the reel part 320 may freely rotate so that the wound wire L is unwound.

In this regard, the rotation restriction part 330 may be configured as a single member, and, in the present embodiment, is illustrated as including two members: an internal restriction part 350 and an external restriction part 340 to improve manufacturing convenience and increase elastic support force.

Specifically, referring to FIGS. 6 and 7, the internal restriction part 350 includes a ring body part 350*a*, elastic blade portions 350*b*, and ratchet coupling portions 350*c*.

In this regard, the ring body part 350*a* has a vertical movement support hole 351 at a central portion thereof, and the elastic blade portions 350*b* protrude from an outer circumference of the ring body part 350*a* outward in a radial direction and extend in one direction in a rounded form.

In addition, the ratchet coupling portion 350*c* is provided at an end portion of the elastic blade portion 350*b* such that an end portion thereof contacting the ratchet gear 311 is in a shape engaged with the ratchet gear 311, and is elastically supported by the elastic blade portion 350*b* outward in a radial direction.

Accordingly, vertical cross-sections of the ratchet coupling portions 350*c* and the ratchet gear 311 are engaged with one another and one-way rotation of the internal restriction part 350 is restricted, and inclined surfaces of the ratchet coupling portions 350*c* and the ratchet gear 311 slide against each other and the internal restriction part 350 may rotate in another direction.

In addition, the ratchet coupling portion 350*c* is provided with an extension protrusion 353 protruding from a lower side of an end portion thereof to form a continuous engagement surface together with the ratchet gear 311. In addition, the ratchet coupling portion 350*c* is provided with a rotation coupling surface portion 354 protruding in a rounded shape inward and outward in a radial direction so as to have a circular cross-section at a side surface portion of a portion thereof connected to the elastic blade portion 350*b*.

Meanwhile, referring to FIGS. 7 and 8, the external restriction part 340 is seated on an edge of an upper end of the housing part 310, and is provided, at a central portion thereof, with a seating groove portion 341 on which the ring body part 350*a* is seated. In addition, the seating groove portion 341 is provided, at a central portion thereof, with a corresponding hole 342 to be connected to the vertical movement support hole 351.

In this regard, the ring body part 350*a* is inserted into and seated on the seating groove portion 341 and the internal restriction part 350 may move upward together with the external restriction part 340 in an integrated manner.

In addition, the seating groove portion 341 is provided, at an edge thereof, with gear connection grooves 343 radially extending in a rounded shape so as for the elastic blade portions 350*b* to be inserted thereinto, each gear connection groove having an opening at a lower surface portion 343*a* thereof corresponding to the ratchet coupling portion 350*c*.

At this time, the extension protrusions 353 pass through the openings of the lower surface portions 343*a* of the gear connection grooves 343 to be engaged with the ratchet gear 311.

In addition, a portion of the gear connection groove 343 into which the elastic blade portion 350*b* is inserted and a portion thereof into which the extension protrusion 353 is inserted may have a predetermined free space, and thus the ratchet coupling portions 350*c* may elastically move inward and outward in a radial direction.

At this time, a portion 343*b* between the portion of the gear connection groove 343 into which the elastic blade portion 350*b* is inserted and a portion thereof into which the extension protrusion 353 is inserted has a circular cross-sectional shape to allow engagement with the rotation coupling surface portion 354. Accordingly, the external and internal restriction parts 340 and 350 may rotate in an integrated form, and the ratchet coupling portions 350*c* may rotatably move about the rotation coupling surface portions 354 inward and outward in a radial direction.

In addition, the ratchet coupling portion 350*c* is provided, at a lower surface portion thereof, with an upwardly recessed elastic support groove portion 352. Specifically, the elastic support groove portion 352 has an opening at a side surface portion inward a radial direction of the ratchet coupling portion 350*c*, the opening being formed along a tangential direction of a portion thereof contacting the ratchet gear 311.

At this time, the gear connection groove 343 may be provided, at one side thereof, with an auxiliary elastic piece 345 extending from an inner circumference of the external restriction part 340 and inserted into the elastic support groove portion 352 so that the ratchet coupling portions 350*c* are elastically supported outward in a radial direction. Accordingly, even when elasticity of the elastic blade portions 350*b* deteriorates, the ratchet coupling portions 350*c* may be stably engaged with the ratchet gear 311 via elastic force of the auxiliary elastic pieces 345.

Meanwhile, a cover part 370 may be coupled to an upper portion of the external restriction part 340 to operate in a rotation direction and upward or downward in an integrated form. In this regard, the cover part 370 has a container shape with a lower opening so that the external restriction part 340 is inserted into a sidewall portion 370*a*. Specifically, the cover part 370 may be hook-coupled or adhered to an upper surface of an edge portion of the external restriction part 340 via protrusions (not shown) downwardly protruding from an upper surface portion 370*b*.

In addition, the cover part 370 is provided with a plurality of support parts 372 downwardly protruding from the upper surface portion 370*b* thereof to support an upper surface portion of the internal restriction part 350. Accordingly, when impact such as shaking, vibration, or the like is applied, escaping of the internal restriction part 350 from the external restriction part 340 may be prevented, and the cover part 370, the internal restriction part 350, and the external restriction part 340 may be manipulated in an integrated manner.

Meanwhile, a gear coupling portion 329 and a gear engagement portion 349 that are selectively coupled to each other by engagement may be formed at an upper portion of the reel part 320 and a lower portion of the external restriction part 340, respectively. Specifically, the gear coupling portion 329 may protrude in plural from the upper surface portion of the reel part 320 along a circumferential direction, and may be formed as gear protrusions configured such that end portions thereof in one direction have vertical cross-sections and end portions thereof in another direction are slanted. In addition, the gear engagement portion 349 may protrude in plural from a lower surface portion of the external restriction part 340 along a circumferential direction and may be formed as gear protrusions such as end portions thereof in one direction are slanted and end portions thereof in another direction has vertical cross-sections.

Accordingly, when the external restriction part 340 moves downward, the gear coupling portions 329 and the gear engagement portions 349 may be coupled to each other so that the reel part 320 and the external restriction part 340 may rotate in another direction in an integrated manner. In addition, when the external restriction part 340 moves upward up to a height of each gear protrusion or greater, the gear coupling portions 329 and the gear engagement portions 349 are separated from each other and the reel part 320 is converted into a free rotation state.

Meanwhile, referring to FIGS. 7 to 9A, the cover part 370 is configured such that a sidewall portion 370*a* has an inner diameter corresponding to an outer diameter of the external restriction part 340, and covers the external restriction part 340 to be coupled thereto. Specifically, hooking protrusions 371 may protrude from an inner circumference of a lower end of the sidewall portion 370*a* of the cover part 370 inward in a radial direction to be hook-coupled to a hook blade portion 314 protruding from an outer circumference of the housing part 310.

In this regard, the cover part 370 is made of a metal, a reinforced plastic, or the like which has a predetermined strength and is elastic, and the hooking protrusions 371 are upwardly slanted towards an inner side in a radial direction such that lower portions thereof are slanted and upper portions thereof are flat.

In addition, the hook blade portion 314 may protrude along an outer circumference of an upper end of the housing part 310, and be configured such that an outer diameter thereof corresponds to an inner diameter of the sidewall portion 370*a* of the cover part 370. At this time, the hook blade portion 314 may be configured such that an upper portion thereof facing lower inclined surfaces of the hooking protrusions 371 has a rounded shape and a lower portion thereof has a flat shape. Accordingly, the hooking protrusions 371 may be caught by a step between the hook blade portion 314 and an outer surface of the housing part 310 so that the cover part 370 and the external restriction part 340 may be hook-coupled.

In addition, the sidewall portion 370*a* of the cover part 370 may vertically extend so that the hooking protrusions 371 and the hook blade portion 314 have a separation distance corresponding to a lifting distance of the rotation restriction part 330.

In this regard, it may be understood that the lifting distance means a distance between a position of the external restriction part 340 at which the gear engagement portions 349 closely contact the gear coupling portions 329 and a position of the external restriction part 340 at which the gear engagement portions 349 and the gear coupling portions 329 are separated from each other.

In addition, the separation distance means a distance that does not allow the hooking protrusions 371 to upwardly escape from the hook blade portion 314 and allows the hooking protrusions 371 to move upward or downward in a state of being positioned at a lower portion of the hook blade portion 314. At this time, the length of the sidewall portion 370*a* of the cover part 370 may be set in consideration of the thicknesses of the external restriction part 340 and the hook blade portion 314. That is, the sidewall portion 370*a* of the cover part 370 may vertically extend so that, when the cover part 370 moves downward, a maximum separation distance between upper surface portions of the hooking protrusions 371 and a lower surface portion of the hook blade portion 314 coincides with the lifting interval.

Accordingly, in a state in which the upper surface portions of the hooking protrusions 371 and the lower surface portion of the hook blade portion 314 are spaced apart from each other, when the cover part 370 moves upward so that the upper surface portions of the hooking protrusions 371 contact the lower surface portion of the hook blade portion 314, the reel part 320 may freely rotate.

In addition, the hook blade portion 314 of the housing part 310 may be provided, at one side thereof, with a pair of slit grooves 316 spaced apart from each other by a distance corresponding to a circumferential width of the hooking protrusions 371.

That is, when the cover part 370 is pressed inward in a radial direction, the hook blade portion 314 between the slit grooves 316 is elastically deformed inward in a radial direction, and thus the hooking protrusions 371 are separated from the hook blade portion 314 and, accordingly, maintenance and repair such as replacement, repair, and the like of components are enabled.

Meanwhile, the vertical movement support shaft part 360 includes a shaft body part 360*a*, elastic pieces 360*b*, and pressure gradient protrusions 361 and is made of a metal, a reinforced plastic, or the like which has a certain degree or more of strength and is elastic. In this regard, the shaft body part 360*a*, the elastic pieces 360*b*, and the pressure gradient protrusions 361 may be injection-molded in an integrated manner.

In particular, the vertical movement support shaft part 360 may be coupled to a coupling hole 315 of the housing part 310 by passing through the vertical movement support hole 351 after the reel part 320, the external restriction part 340, and the internal restriction part 350 are sequentially assembled in the housing part 310.

In this regard, a lower portion of the shaft body part 360*a* may have a cylindrical shape divided by a slit so as to have elastic force and may be provided with a hook protrusion 362 protruding outward in a radial direction along an outer circumference of the divided lower end portion.

In addition, the housing part 310 is provided with the coupling hole 315 through which the lower portion of the shaft body part 360*a* passes, at a bottom surface thereof. That is, the hook protrusion 362 may be hook-coupled to the coupling hole 315 after the lower portion of the shaft body part 360*a* passes through the vertical movement support hole 351, the corresponding hole 342, and a shaft through-hole 324 of the reel part 320.

In this regard, the coupling hole 315 may have an inner diameter corresponding to an outer diameter of the lower portion of the shaft body part 360*a*, and an inner circumference of a lower portion of the coupling hole 315 may extend outward in a radial direction so that a step portion 315*a* is formed on one side of the inner circumference.

In addition, the hook protrusion 362 may protrude to a size that is greater than an inner diameter of an engaged upper portion of the coupling hole 315, and may be upwardly slanted towards outside in a radial direction such that a lower surface portion thereof has an inclined shape and an upper surface portion thereof has a flat shape.

At this time, a depth of the step portion 315*a* corresponds to a vertical height of the hook protrusion 362, and the hook protrusion 362 is caught by the step portion 315*a* and, accordingly, an exterior appearance of a rear surface portion of the housing part 310 may be improved.

Accordingly, the vertical movement support shaft part 360 and the housing part 310 may be readily assembled without a fixing member such as bolts of a metal material. In addition, breakdown of a resin injection material that may occur due to metal components used as a fixing member may be prevented even when malfunctions such as excessive pulling and the like are performed, resulting in improvement in durability of products.

As such, all constituent components are assembled by one touch-type hook coupling via protrusions injection-molded in an integrated manner, and thus assemblability of products may be significantly enhanced.

Meanwhile, the shaft body part 360*a* may have an outer diameter that is less than a diameter of the shaft through-hole 324 of the reel part 320, and the elastic pieces 360*b* may have an outer diameter that is greater than the diameter of the shaft through-hole 324 of the reel part 320. That is, the outer surfaces of the elastic pieces 360*b* is in a shape protruding from the outer surface of the shaft body part 360*a* outward in a radial direction, and a connection portion 363 is formed as a step between the outer surfaces of the elastic pieces 360*b* and the outer surface of the shaft body part 360*a*.

At this time, a height of the shaft body part 360*a* may correspond to a distance from the bottom surface of the housing part 310 to an edge of an upper end of the shaft through-hole 324, and the connection portion 363 may be seated on the edge of the upper end of the shaft through-hole 324.

Accordingly, upward or downward movement of the vertical movement support shaft part 360 is prevented, and the housing part 310, the reel part 320, and the vertical movement support shaft part 360 may be stably coupled to one another.

Meanwhile, referring to FIGS. 9A and 9B, the elastic pieces 360*b* extend upward from the upper end of the shaft body part 360*a* to be divided by a plurality of slits and are configured to pass through the vertical movement support hole 351.

At this time, the elastic pieces 360*b* may have a length that allows upper end portions thereof to be exposed upward of the vertical movement support hole 351 when the rotation restriction part 330 moves upward.

In addition, the elastic pieces 360*b* may have a cylindrical shape divided by the slits to have elastic support force, may be tightened inward in a radial direction by external force, and may be restored outward in a radial direction when the external force is not applied. In this regard, the slit may have a vertical shape or an inclined shape. At this time, the pressure gradient protrusions 361 may protrude from outer surfaces of upper portions of the elastic pieces 360*b* in a rounded shape outward in a radial direction.

In this regard, the pressure gradient protrusions 361 may be formed from the elastic pieces 360*b* to portions thereof facing an inner circumference of the vertical movement support hole 351 along a portion exposed to the upper portion of the vertical movement support hole 351, when the rotation restriction part 330 moves downward.

At this time, a maximum protrusion height of the pressure gradient protrusions 361 may be set to exceed a minimum inner diameter of the vertical movement support hole 351. For example, lower portions of the pressure gradient protrusions 361 may protrude less than the inner diameter of the vertical movement support hole 351, and upper portions thereof may protrude greater than the inner diameter of the vertical movement support hole 351. At this time, it may be understood that the upper portions of the pressure gradient protrusions 361 are positioned at the upper portion of the vertical movement support hole 351 in a state in which the rotation restriction part 330 moves downward.

That is, the pressure gradient protrusions 361 may have an outer surface profile inclined outward in a radial direction towards an upper side, and the vertical movement support hole 351 may be elastically supported as the elastic pieces 360*b* are elastically tightened and restored.

Accordingly, when the rotation restriction part 330 moves downward, the edge of the vertical movement support hole 351 may be elastically supported downward by inclined outer surfaces of the pressure gradient protrusions 361, and the downward movement state of the rotation restriction part 330 may be stably maintained.

At this time, the edge of the vertical movement support hole 351 means a minimum inner diameter portion of the vertical movement support hole 351. For example, when the vertical movement support hole 351 has a cylindrical shape having a constant inner diameter, the edge of the vertical movement support hole 351 may directly contact the outer surfaces of the pressure gradient protrusions 361. In addition, in a case in which a separate protrusion 351*a* is provided at the inner circumference of the vertical movement support hole 351, an edge of the protrusion 351*a* may contact the outer surfaces of the pressure gradient protrusions 361.

In addition, support protrusions 373 may protrude from an upper surface portion 370*b* of the cover part 370 to be inserted into the inner circumference of the elastic pieces 360*b*, and the support protrusions 373 may have an outer diameter corresponding to the inner diameter of the elastic pieces 360*b*.

In addition, the length of the support protrusions 373 may be set such that, when the cover part 370 moves downward, the support protrusions 373 are inserted into the elastic pieces 360*b*, and, when the cover part 370 moves upward, the support protrusions 373 are separated outward from the elastic pieces 360*b*.

Accordingly, when the cover part 370 moves downward, contraction of the elastic pieces 360*b* may be prevented by the support protrusions 373, and thus downward support force of the rotation restriction part 330 may be enhanced through the elastic pieces 360*b* and the pressure gradient protrusions 361.

At this time, when the cover part 370 moves upward, the support protrusions 373 are separated from the elastic pieces 360*b*. In addition, as the rotation restriction part 330 moves upward, the inner circumference of the vertical movement support hole 351 presses the outer surfaces of the pressure gradient protrusions 361 to be slid, and the elastic pieces 360*b* may be elastically tightened inward in a radial direction. Accordingly, the reel part 320 may be separated from the rotation restriction part 330 and thus freely rotate.

In addition, when upward external force applied to the rotation restriction part 330 is not applied, the edge of the upper end of the vertical movement support hole 351 is pressed downward along the inclined surfaces of the pressure gradient protrusions 361 by elastic restoration force acting outward in a radial direction of the elastic pieces 360*b*. Accordingly, the rotation restriction part 330 may move downward again to be coupled to the reel part 320.

Meanwhile, it is more preferable that the fixing protrusion 351*a* protruding inward in a radial direction is provided at an inner circumference of a lower end portion of the vertical movement support hole 351. In addition, a fixing groove portion 361*a* inward recessed in a radial direction may be provided at the outer surfaces of the pressure gradient protrusions 361 so that the fixing protrusion 351*a* is elastically caught.

In this regard, an inner cross-section of the fixing protrusion 351*a* and the recessed surface of the fixing groove portion 361*a* have a round shape, and the fixing groove portion 361*a* corresponds to a position of the fixing protrusion 351*a* when the rotation restriction part 330 moves upward.

At this regard, the fixing protrusion 351*a* may be inserted into the fixing groove portion 361*a* and thus the lifting state of the rotation restriction part 330 may be maintained. In addition, when the cover part 370 is slightly touched downward, the fixing protrusion 351*a* may escape from the fixing groove portion 361*a* and the rotation restriction part 330 may move downward by elastic restoration force of the elastic pieces 360*b*.

The lifting state maintenance structure of the rotation restriction part 330 may be replaced by adjusting the length of the elastic pieces 360*b* and forming gradient surfaces inclined inward in a radial direction towards an upper side at upper portions of the pressure gradient protrusions 361.

For example, the pressure gradient protrusions 361 may protrude from portions corresponding to the inside of the vertical movement support hole 351 of the rotation restriction part 330 moving downward such that portions exposed upward of the vertical movement support hole 351 have outer surfaces inclined outward in a radial direction towards the upper side.

In addition, the pressure gradient protrusions 361 may be slanted in a different direction from portions corresponding to the edge of the lower end of the vertical movement support hole 351 of the rotation restriction part 330 moving upward, and thus may be slanted inward in a radial direction towards the upper side. At this time, connection portions between the lower and upper portions of the pressure gradient protrusions 361, in which the slanted direction is changed, have a round shape.

Accordingly, when the rotation restriction part 330 moves downward, the pressure gradient protrusions 361 may elastically support downward the edge of the upper end of the vertical movement support hole 351, and, when the rotation restriction part 330 moves upward, the pressure gradient protrusions 361 may elastically support upward the edge of the lower end of the vertical movement support hole 351.

Applications of the wire tightening apparatus 100 according to the present invention are not limited to shoes, and applications thereof to other apparatuses to which the technical spirit of the present invention is applied, such as other hats, bags, and the like with laces to be tightened, should be construed as being within the scope of the present invention.

As described above, the present invention is not limited to the above-described embodiments, various modifications may be made in the present invention by those of ordinary skill in the art to which the present invention pertains without departing from the scope of the following claims, and these modifications should be construed as being within the scope of the present invention.

INDUSTRIAL APPLICABILITY

The present invention may be usefully used in industrial fields such as shoes, hats, bags, and the like to which laces or wires to be tightened are applied in accordance with the size of the body of a user.

What is claimed is:

1. A wire tightening apparatus comprising:

a bottom part provided with an accommodation groove at an upper surface portion thereof;

a reel part rotatably inserted into the accommodation groove and allowing a wire to be selectively wound thereon during rotation;

a housing part comprising a fixing barrier part, a lower end portion of which is fixed to the accommodation groove, an extension part extending inward in a radial direction along an inner circumference of the fixing barrier part to cover the reel part and provided with a hollow-type support tube part at a central portion thereof, and an elastic blade portion positioned at an upper portion of the extension part and provided with a ratchet coupling part at an end portion thereof;

a vertically moving gear part provided with a ratchet gear protruding from an inner circumference thereof so that one-way rotation thereof is restricted by the ratchet coupling part and vertically moving by external force; and a cover part coupled to an upper portion of the vertically moving gear part to move upward or downward and rotate in an integrated manner and provided, at a lower surface portion thereof, with a lifting protrusion guided along the support tube part to be coupled to an upper surface portion of the reel part when moving downward.

2. The wire tightening apparatus according to claim 1, wherein the vertically moving gear part is provided with a plurality of elastic pieces facing an outer circumference of the support tube part and provided with slide protrusions protruding from inner surface portions thereof, and the support tube part is provided with a pressure fixing step protruding from the outer circumference of the support tube part, by which the slide protrusions are elastically caught when the vertically moving gear part moves upward or downward.

3. The wire tightening apparatus according to claim 1, wherein the vertically moving gear part is provided with a first hook projection protruding from an inner surface of a sidewall portion thereof to be hook-coupled to a hook step protruding from an outer surface of the fixing barrier part, and an upper end of the first hook projection and a lower end of the hook step are spaced apart from each other to correspond to a lifting interval of the vertically moving gear part when hook-coupled.

4. The wire tightening apparatus according to claim 1, wherein a sidewall portion of the vertically moving gear part is hook-coupled to the fixing barrier part, a sidewall portion of the cover part is hook-coupled to the sidewall portion of the vertically moving gear part to cover and support the sidewall portion of the vertically moving gear part, the cover part is provided with a gear assembly part gear-coupled to the vertically moving gear part at a lower surface portion thereof, and the reel part is provided with a gear coupling part selectively gear-coupled to the lifting protrusion at an upper surface portion thereof.

5. The wire tightening apparatus according to claim 1, wherein the fixing barrier part is provided, at a lower end portion thereof, with a plurality of hook blade portions to be hook-coupled to the fixing step protruding from an inner circumference of the accommodation groove, the hook blade portions being provided with fixing projections at outer surface portions thereof, and the elastic blade portions are provided, at inner surfaces thereof, with distance maintenance portions protruding inward in a radial direction towards an outer circumference of the support tube part.

6. A wire tightening apparatus comprising:

a housing part provided with a one-way ratchet gear along a circumferential direction at an inner circumference thereof;

a reel part rotatably inserted into the housing part and allowing a wire to be selectively wound thereon;

a rotation restriction part engaged with the ratchet gear, by which one-way rotation thereof is restricted, provided with a vertical movement support hole with upper and lower openings along a central portion thereof, and moving upward or downward by external force such that, when moving downward, the rotation restriction part is coupled to an upper portion of the reel part to rotate in an integrated manner; and a vertical movement support shaft part comprising a shaft body part coupled to a lower portion of the housing part, elastic pieces extending upward from an upper end of the shaft body part to be divided by a plurality of slits and passing through the vertical movement support hole, and pressure gradient protrusions protruding from outer surfaces of the elastic pieces to exceed an inner diameter of the vertical movement support hole so that the vertical movement support hole is elastically supported by elastic tightening and restoration of the elastic pieces, wherein a cover part is coupled to an upper portion of the rotation restriction part to vertically operate in a rotation direction in an integrated manner, hooking protrusions protrude from an inner circumference of a lower end of a sidewall portion of the cover part to be hook-coupled to a hook blade portion protruding from an outer circumference of the housing part, and the sidewall portion vertically extends so that the hooking protrusions and the hook blade portion have a separation distance corresponding to a lifting interval of the rotation restriction part.

7. The wire tightening apparatus according to claim 6, wherein the rotation restriction part comprises an internal restriction part comprising a ratchet coupling portion selectively engaged with the ratchet gear along an end portion of an elastic blade portion extending outward in a radial direction from a ring body part provided with the vertical movement support hole at a central portion thereof so that one-way rotation of the ratchet coupling part is restricted, and an external restriction part provided with a seating groove portion on which the ring body part is seated at a central portion thereof and having a corresponding hole connected to the vertical movement support hole, and a gear connection groove radially extending in a rounded shape along an edge of the seating groove portion to be inserted into the elastic blade portion and having an opening at a lower surface portion thereof corresponding to the ratchet coupling part.

8. The wire tightening apparatus according to claim 7, wherein a gear coupling portion and a gear engagement portion, selectively coupled to each other by engagement, are formed at an upper portion of the reel part and a lower portion of the external restriction part, respectively, the ratchet coupling part is provided with an elastic support groove portion, a lower surface portion thereof is recessed upward, to have an opening at a side surface portion formed along a tangential direction of a portion thereof contacting the ratchet gear, and the gear connection groove is provided, at one side thereof, with an auxiliary elastic piece extending from an inner circumference of the external restriction part and inserted into the elastic support groove portion so that the ratchet coupling portions are elastically supported outward in a radial direction.

9. The wire tightening apparatus according to claim 6, wherein the housing part is provided with a coupling hole through which a lower portion of the shaft body part passes, at a bottom surface thereof, a lower portion of the shaft body part has a cylindrical shape divided by a slit and is provided with a hook protrusion protruding outward in a radial direction along an outer circumference of the divided lower end portion to be hook-coupled to the coupling hole, fixing protrusion protruding inward in a radial direction is provided at an inner circumference of a lower end portion of the vertical movement support hole, and a fixing groove portion inward recessed in a radial direction is provided at outer surfaces of the pressure gradient protrusions so that the fixing protrusion is elastically caught.

* * * * *